US008011805B2

(12) United States Patent
Chiang

(10) Patent No.: US 8,011,805 B2
(45) Date of Patent: Sep. 6, 2011

(54) POINTLESS ILLUMINATION DEVICE

(75) Inventor: Jung Hwa Chiang, Chung-Ho (TW)

(73) Assignee: Bright View Electronics Co., Ltd., Chung-Ho, Taipei Hsien (TW)

( * ) Notice: Subject to any disclaimer, the term of this patent is extended or adjusted under 35 U.S.C. 154(b) by 363 days.

(21) Appl. No.: 12/423,943

(22) Filed: Apr. 15, 2009

(65) Prior Publication Data

US 2010/0157600 A1 Jun. 24, 2010

(30) Foreign Application Priority Data

Oct. 23, 2008 (TW) ..... 97218916 U

(51) Int. Cl.
*F21S 4/00* (2006.01)
*F21V 21/00* (2006.01)

(52) U.S. Cl. ..... 362/249.02; 362/225; 362/311.02; 362/800

(58) Field of Classification Search ..... 362/217.01, 362/225, 249.02, 311.02, 800
See application file for complete search history.

(56) References Cited

U.S. PATENT DOCUMENTS

2010/0033964 A1* 2/2010 Choi et al. ..... 362/234
* cited by examiner

*Primary Examiner* — Jason Moon Han
(74) *Attorney, Agent, or Firm* — Guice Patents PLLC

(57) ABSTRACT

The present invention relates to a pointless illumination device, comprising: a body; a cover, made of a light spreading material which can uniformly spread out the light of a plurality of light emitting devices; a light source module; a first contact portion; and a second contact portion. The light emitted from the light source module is uniformly spread through the cover so that the phenomenon of pointwise illumination does not exist in the illumination device.

8 Claims, 3 Drawing Sheets

POINTLESS ILLUMINATION DEVICE

BACKGROUND OF THE INVENTION

1. Field of the Invention

The present invention relates to an illumination device, especially to a pointless illumination device, having a cover capable of uniformly spreading the light of a plurality of light emitting devices so that the phenomenon of pointwise illumination does not exist in the illumination device.

2. Description of the Related Art

Up to now, the fluorescent lamp has long been used as illumination device for households and factories. However the flashing of the fluorescent lamp due to AC power may make users' eyes feel uncomfortable. Besides, the fluorescent lamp consumes a lot of power and has a poison fluorescent powder coated on the lamp wall so it does not comply with the demands of environmental protection.

For present, there are some lamps utilizing light emitting diodes as light source to save power and comply with the demands of environmental protection. However, due to the directionality of the light emitting diodes, the lamps utilizing light emitting diodes as light source, if not further processed, are incline to have the phenomenon of pointwise illumination and make users' eyes feel uncomfortable. This is a major disadvantage remained to be fixed.

SUMMARY OF THE INVENTION

In view of the description above, an objective of the present invention is to provide a pointless illumination device which can eliminate the phenomenon of pointwise illumination.

Still another objective of the present invention is to provide a pointless illumination device which comprises a cover capable of uniformly spreading the light of a plurality of light emitting devices.

To accomplish the objectives mentioned above, the present invention offers a pointless illumination device, comprising: a body, having two approximately parallel grooves at two sides; a cover, capable of mating with the body to form an accommodating room, the cover having two approximately parallel obtruding portions movable in the two approximately parallel grooves; a light source module, placed in the accommodating room, comprising a board engaging the body in the two approximately parallel grooves, the board further comprising a plurality of light emitting devices and at least one driving circuit; a first contact portion, detachable at one end of said body; and a second contact portion, detachable at another end of the body, used together with the first contact portion to provide the power supply contacts for the light source module.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

FIG. 2(*b*) is a local cross section view of FIG. 2(*a*).

DETAILED DESCRIPTION OF THE PREFERRED EMBODIMENTS

The present invention will now be described in more detail hereinafter with reference to the accompanying drawings that show various embodiments of the invention.

Figure 1:
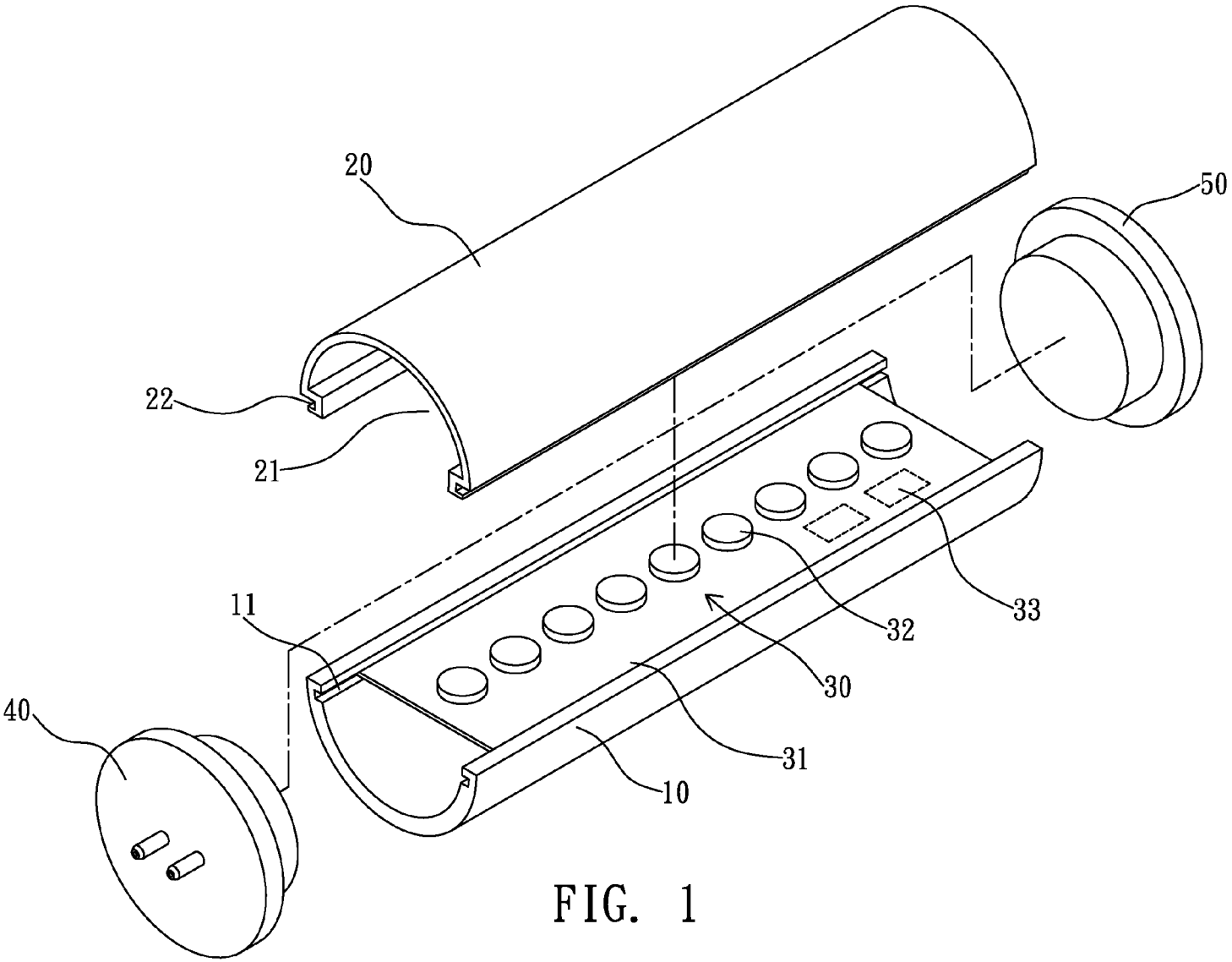
FIG. 1 is an exploded view of a preferred embodiment of a pointless illumination device of the present invention.
Figure 2A:
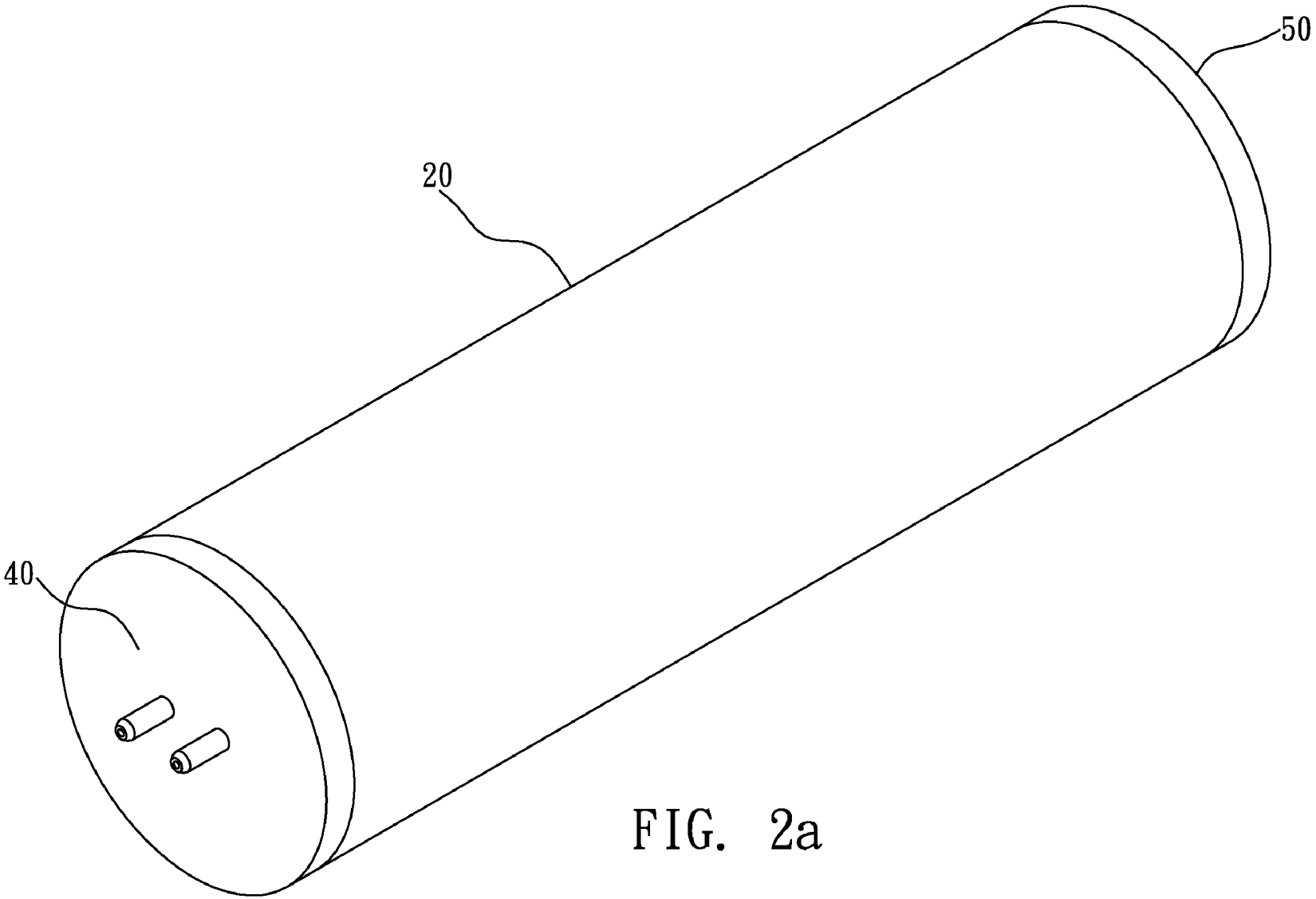
FIG. 2(*a*) is an assembly schematic illustration of a preferred embodiment of a pointless illumination device of the present invention.
Figure 2B:
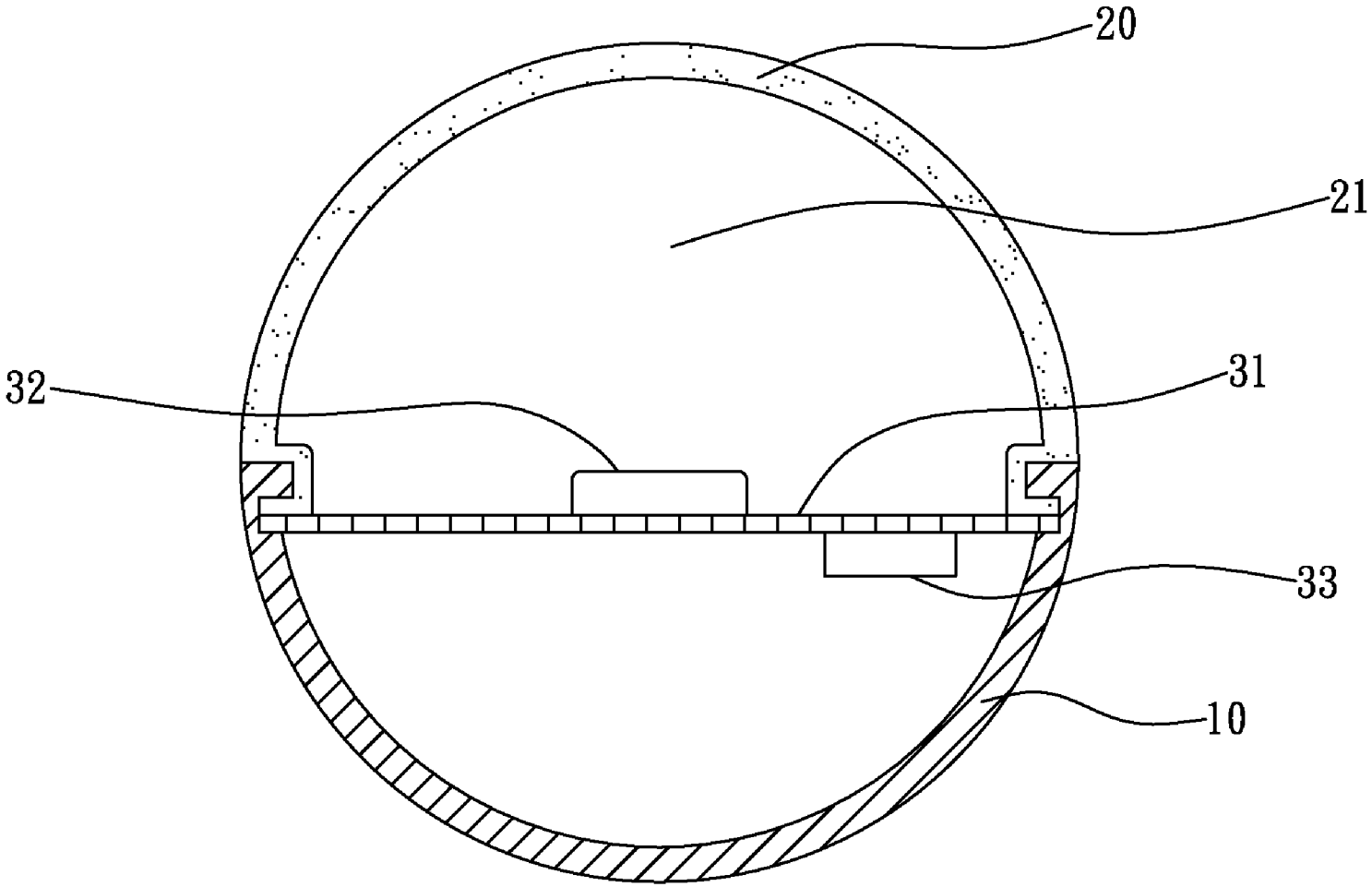

Please refer to FIG. 1~FIG. 2(*b*) first. FIG. 1 shows an exploded view of a preferred embodiment of pointless illumination device of the present invention; FIG. 2(*a*) is an assembly schematic illustration of a preferred embodiment of a pointless illumination device of the present invention; FIG. 2(*b*) is a local cross section view of FIG. 2(*a*).

As indicated in the drawings, the present pointless illumination device includes: a body 10; a cover 20; a light source module 30; a first contact portion 40; and a second contact portion 50.

In this device, the body 10 has an approximately semicircle cross section and is made of a light transparent material, for example but not limited to glass or plastic, and has two approximately parallel grooves 11 at two sides.

The cover 20 is capable of mating with the body 10 to form an accommodating room 21, and has two approximately parallel obtruding portions 22 movable in the two approximately parallel grooves 11. The cover 20 also has an approximately semicircle cross section and is made of a light spreading material, for example but not limited to silicon dioxide ($SiO_2$) or titanium dioxide ($TiO_2$), which can uniformly spread out the light from the light source module 30 to eliminate the phenomenon of pointwise illumination.

The light source module 30, placed in the accommodating room 21, comprises a board 31 engaging the body 10 in the two approximately parallel grooves 11. The board 31 further comprises a plurality of light emitting devices 32 and at least one driving circuit 33. The plurality of light emitting devices 32 are for example but not limited to high brightness light emitting diodes (LED), approximately equally spaced on the board 31, and the light of which being emitted through the cover 20. The driving circuit 33 coupled to the plurality of light emitting devices 32 for driving them is prior art and not the focus of the present invention, so it will not be addressed here.

The first contact portion 40, detachable at one end, for example but not limited to the left end of the body 10, is coupled to the driving circuit 33 for supplying power.

The second contact portion 50, detachable at another end, for example but not limited to the right end of the body 10, is coupled to the driving circuit 33 and used together with the first contact portion 40 to provide the power supply contacts for the light source module 30.

As shown in FIG. 2(*a*), the pointless illumination device can be assembled as the steps of: welding the plurality of light emitting devices 32 and at least one driving circuit 33 on the board 31; assembling the board 31 into the accommodating room 21 by engaging the edges of board 31 with the grooves 11 and sliding the board 31 thereby; mating the cover 20 with the body 10 by engaging the obtruding portions 22 with the grooves 11 and sliding the cover 20 thereby; connecting the first contact portion 40 with the driving circuit 33 by inserting the first contact portion 40 into the left end of the body 10; and connecting the second contact portion 50 with the driving circuit 33 by inserting the second contact portion 50 into the right end of the body 10. The pointless illumination device can access power through the first contact portion 40 and the second contact portion 50 to facilitate the driving circuit 33 driving the plurality of light emitting devices 32. The emitted light is then uniformly spread out through the cover so that the phenomenon of pointwise illumination does not exist in the illumination device.

As shown in FIG. 2(*b*), the depth of the groove 11 is slightly greater than that of the sum of the obtruding portion 22 and the board 31, so the groove 11, after accommodating the board 31, still has enough depth for the obtruding portion 22 of the cover 20 to slide in there, and therefore makes the body 10, cover 20 and light source module 30 easy to assembly and disassembly.

As a conclusion, through the application of the pointless illumination device of the present invention, the light emitted from the light source module can be uniformly spread out through the cover so as to eliminate the phenomenon of pointwise illumination, and the pointless illumination device is easy to assembly and easy to disassembly; therefore, the present invention does conquer many disadvantages of the known arts and offer a lot of superior advantages.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. A pointless illumination device, comprising:

a light transmissive body, consisting of two approximately parallel grooves at two sides;

a light transmissive body cover, capable of mating with said body to form an accommodating room, said cover having two approximately parallel obtruding portions movable in said two approximately parallel grooves;

a light source module, placed in said accommodating room, comprising a board engaging said body in said two approximately parallel grooves, said board further comprising a plurality of light emitting devices and at least one driving circuit;

a first contact portion, detachable at one end of said body; and a second contact portion, detachable at another end of said body, used together with said first contact portion to provide the power supply contacts for said light source module.

2. The pointless illumination device of claim 1, wherein said body has an approximately semicircle cross section and is made of a light transparent material.

3. The pointless illumination device of claim 2, wherein said cover has an approximately semicircle cross section and is made of a light spreading material which can uniformly spread out the light of said plurality of light emitting devices.

4. The pointless illumination device of claim 3, wherein said light spreading material is silicon dioxide or titanium dioxide.

5. The pointless illumination device of claim 1, wherein said light emitting device is high brightness light emitting diode.

6. The pointless illumination device of claim 5, wherein said driving circuit is light emitting diode driving circuit.

7. The pointless illumination device of claim 1, wherein said plurality of light emitting devices are approximately equally spaced on said board, and the light of which is emitted through said cover.

8. The pointless illumination device of claim 1, wherein the depth of said groove is slightly greater than that of the sum of said obtruding portion and said board.

* * * * *